US008628215B2

(12) United States Patent
Tsai

(10) Patent No.: US 8,628,215 B2
(45) Date of Patent: Jan. 14, 2014

(54) LED LIGHT STRING

(75) Inventor: Chang Fu Tsai, Taichung (TW)

(73) Assignee: Tung Ling Wang, Taichung (TW)

( * ) Notice: Subject to any disclaimer, the term of this patent is extended or adjusted under 35 U.S.C. 154(b) by 18 days.

(21) Appl. No.: 13/423,807

(22) Filed: Mar. 19, 2012

(65) Prior Publication Data

US 2013/0182439 A1 Jul. 18, 2013

(30) Foreign Application Priority Data

Jan. 17, 2012 (TW) ..... 101201015 U

(51) Int. Cl.
*F21S 4/00* (2006.01)

(52) U.S. Cl.
USPC ..... 362/249.06; 362/249.14; 362/647; 362/652; 439/466; 439/906

(58) Field of Classification Search
USPC ..... 362/647, 652, 653, 654, 655, 656, 362/249.01, 249.02, 249.06, 249.14, 362/249.16, 249.11; 439/465, 466, 904, 439/906
See application file for complete search history.

(56) References Cited

U.S. PATENT DOCUMENTS

| | | | | |
|---|---|---|---|---|
| 5,121,310 | A * | 6/1992 | Ahroni | 362/238 |
| 5,330,368 | A * | 7/1994 | Tsuruzono | 439/409 |
| 5,672,000 | A * | 9/1997 | Lin | 362/249.06 |
| 6,017,241 | A * | 1/2000 | Komai | 439/419 |
| 6,719,441 | B2 * | 4/2004 | Wong | 362/267 |
| 6,793,369 | B2 * | 9/2004 | Calzaretta et al. | 362/219 |
| 7,137,852 | B2 * | 11/2006 | Tsukamoto | 439/698 |
| 7,798,668 | B2 * | 9/2010 | Cunius | 362/133 |
| 2010/0254161 | A1 * | 10/2010 | Liu et al. | 362/654 |

* cited by examiner

*Primary Examiner* — John A Ward
(74) *Attorney, Agent, or Firm* — Muncy, Geissler, Olds & Lowe, PLLC

(57) ABSTRACT

A design of light string comprises a bulb socket, a pair of conductive wires, and LED electrically disposed onto the bulb socket. The LED is incorporated with a pair of legs which are alternatively in contact with the pair of conductive wires, and then are sandwiched between a pair of first and second casings which jointly configures the light bulb. This configuration simplifies the assembling of the conductive wires and LED such that no need of solder or glue or contacts.

7 Claims, 5 Drawing Sheets

LED LIGHT STRING

BACKGROUND OF THE INVENTION

1. Field of the Invention

The present invention relates to a light string, and more particularly to a light string which is configured with simple configurations of a socket, a pair of conductive wires, and an LED electrically seated onto the socket.

2. Description of Prior Art

The conventional light string, such as the light strings generally used in Christmas and New Year season, which is mostly assembled manually. Among one of the light strings, it is generally configured with five essential components, i.e. light bulb, bulb holder, socket, contacts and conductive wires. The contacts are stamped and bent to attach to the conductive wires, and then the sub-assembly of the contact-conductive wires are assembled to the socket. Then the light bulb along with its bulb holder is assembled to the socket so as to complete the assembly of a conventional light string.

There is another conventional light string, and which is configured with a light bulb with two conductive legs, solder, glue, a pair of conductive wires and a heat shrinkable tube. Firstly, the insulative layer of the conductive wires are removed so as to expose a section of copper. Then those two conductive legs are soldered to the copper respectively and enveloped with a layer of glue around a solder joint formed thereof so as to provide a reliable interconnection. Finally, the heat shrinkable tube is enveloped onto the solder joint and then heat is applied to make the seal between the conductive legs and the conductive wires. However, this conventional light string is still reliable on manual assembling.

Since manual assembling is time consuming, and human mistakes are frequently happened during assembling and causing high yield of defective light string. In addition, the work stations for manual assembling is comparably redundant and complicated which all attribute to high material cost and increase burden of assembling. This makes the assembling and management complicated.

SUMMARY OF THE INVENTION

It is an object of the present invention to provide a light string which is compactly configured by a plurality of bulb sockets interconnected with conductive wires, and a plurality of light emitting diodes (LED) installed onto the bulb sockets. The LED is incorporated with a pair of legs interconnected with the conductive wires, and further sandwiched by the bulb socket which is conveniently configured with first and second casings. The overall configuration is readily simplified to conductive wires and LEDs, thereby reducing the use of solder, or glue, and contacts needed for interconnections between conventional light bulb and conductive wires. Material cost is tremendously reduced, and the overall configuration has been modified and easily adapted for mass production with automation. Laborious assembling is not relied anymore. As a result, human errors are reduced and the overall process can be easily managed.

It is still an object of the present invention to provide a light string in which conductive legs of the LED are in contact with the conductive wires.

It is still an object of the present invention to provide a light string, in which the LED is incorporated with insulative displacement contact (IDC) to electrically engage with the conductive wires.

It is still an object of the present invention to provide a light string in which the LED is incorporated with IDC contacts which can be further wrapped over the conductive wires so as to provide a strain relief so as to prevent an interconnection between the IDC and conductive wires from separating.

DETAILED DESCRIPTION OF THE PREFERRED EMBODIMENT

The drawings illustrate the preferred embodiments along with its featured characteristics and other practical functions. Detailed description will be given below.

Figure 1:
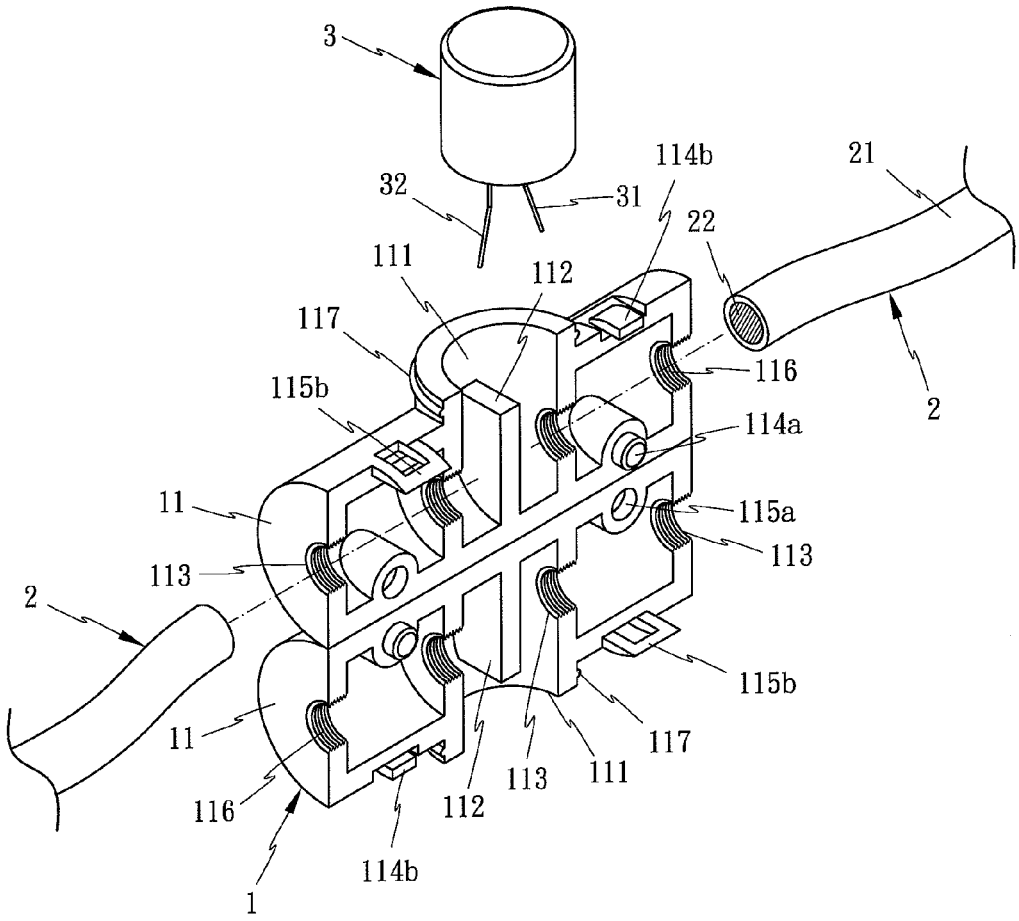
FIG. 1 is a perspective view of a light string made according to an embodiment of the present invention.
Figure 2:
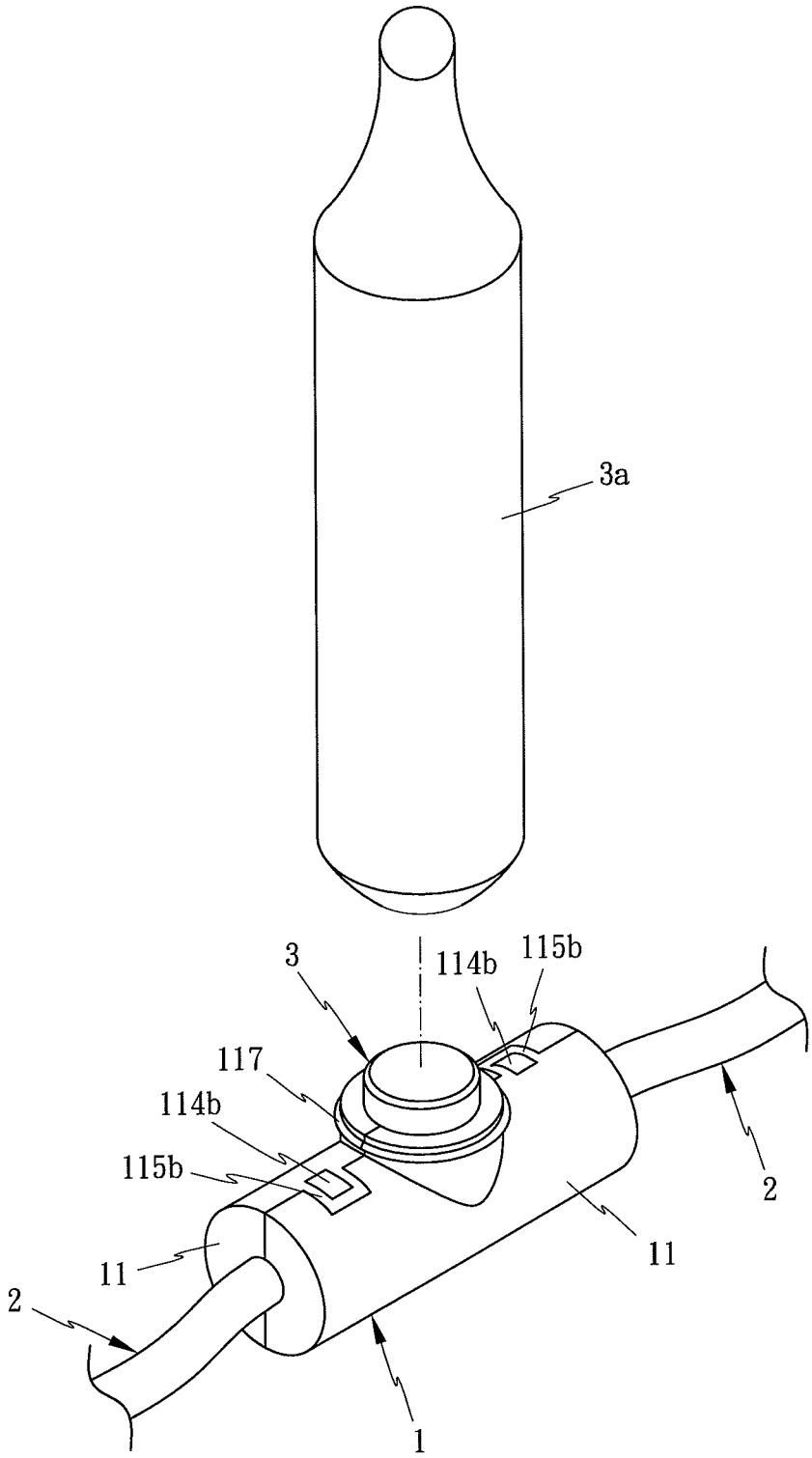
FIG. 2 is an assembled view of FIG. 1.
Figure 3:
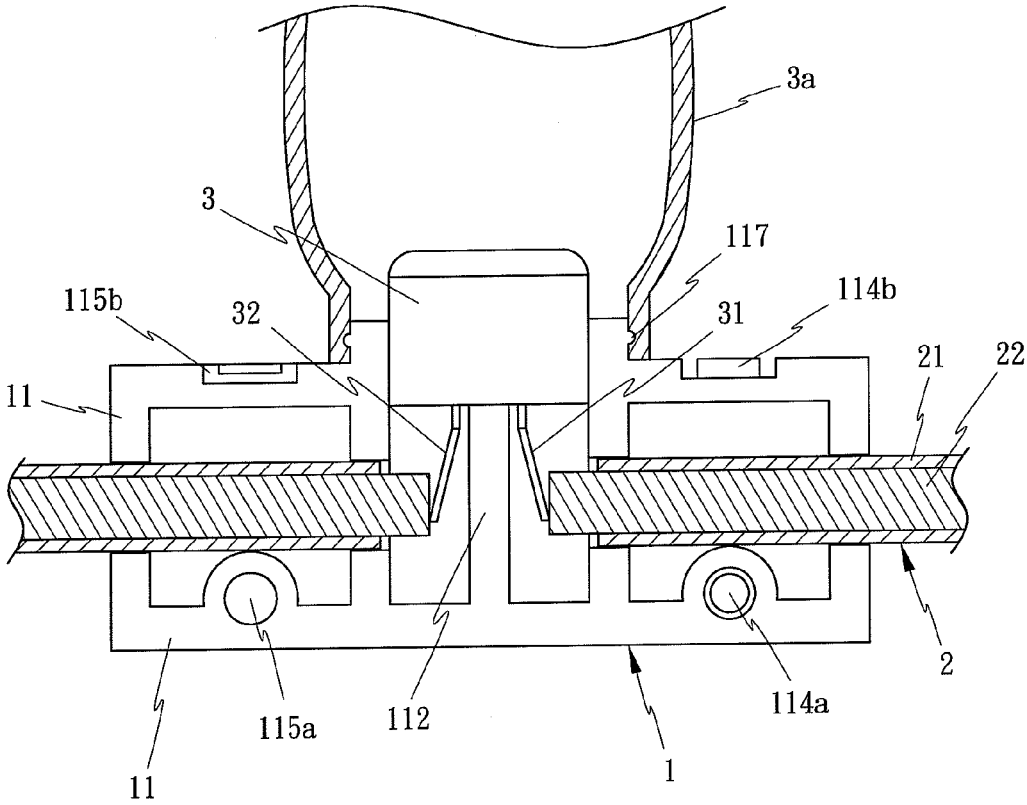
FIG. 3 is a cross sectional view of FIG. 2, in which legs of LED are in contact with conductive wires.

As shown in FIGS. 1 to 3, a light string made in accordance to the present invention comprises a plurality of bulb socket 1, in which only one is shown for illustration, a pair of conductive wires 2, and a plurality of LEDs 3 electrically disposed within the bulb socket 1.

As shown in FIG. 1, a genuine socket 1 is symmetrically configured by a first and second casings 11 of hollow configuration. Each of the first and second casings 11 is defined with an opening 111 having a partition 112 located thereunder. An internal wall, of the first and second casings 11 is formed with a pair of channels 113 located at longitudinal ends thereof. On the other hand, the internal wall of the first and second casings 11 is also provided with interengaging arrangements, such as illustrated as the embodiments to be discussed below. The first and second casings 11 can be interlinked with an interleaf, or they can be separated as two individual part. As shown, buttons 114*a* and button holes 115*a* are provided and interlocked with each other when the first and second casings 11 come together. In addition, latch 114*b* and latch holes 115*b* are also provided on the edge for enhancing the securement. By this arrangement, the socket 1 configured by the first and second casings 11 are reliably secured. By this arrangement, the bulb socket 1, is therefore established. After the first and second casing 11 are securely interlocked with each other, the opening 111 from each of the two casings 11 are jointly defined a seat for installation of an LED 3. Those two channels 113 are further defined two passages for holding and routing a conductive wires 2 therethrough, and further insulatively separated by the partition 112. An internal wall of the channel 113 is also provided with a plurality of teeth 116 which can get bite on an insulative layer 21 of the conductive wires 2. Alternatively, the teeth 116 can be replaced with other arrangements such as a rough surface, a plurality of pikes etc.

The conductive wires 2 is a prior art, and it includes an insulative layer 21 and copper wire 22.

The LED 3 is provided with a pair of legs 31, 32 which are securely disposed within the recess such that the pair of legs 31, 32 are in contact with the copper wires 22 of the conductive wire 2. When those components are put in place, the first and second casings 11 are interengaged together so as to establish the light string.

The LED seat configured and matched by the symmetrical openings 111 of the first and second casings 11 is provided with a circular rib 117 after the two are joined together. By this arrangement, a light guide 3*a* is enveloped onto the LED 3 by the engagement with the circular rib 117.

The overall configuration is compactly configured by the plurality of bulb socket 1, the plurality of conductive wires 2, and the plurality of LEDs 3 electrically disposed within the bulb socket 1. The legs 31, 32 of the LED 3 are each electrically interconnects to the copper wire 22, and which are further enclosed by the marry of the first and second casings 11. By this arrangement, the light string is therefore compactly configured as it can be readily seen that the manufacturing of the light string is simplified by integration of the conductive wire 2 and the LED 3. As such, the conventional interconnection arrangements, such as solder, glue and contacts can be reduced. The overall cost is also reduced. This simplified manufacturing process is therefore more readily for automation for mass production. No laborious manual works are needed. This is readily suitable for mass production.

As shown in FIG. 3, the conductive legs 31, 32 are individually in contact with the copper wire 22 so as to make electrical interconnection.

Figure 4:
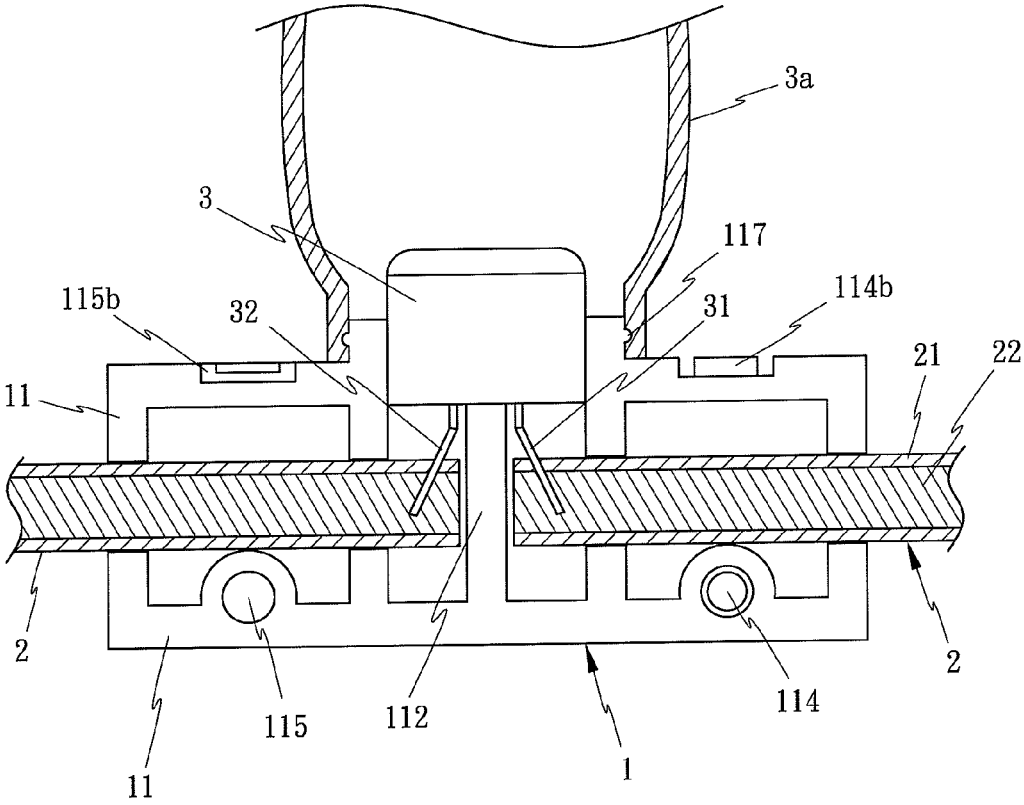
FIG. 4 is a cross sectional view illustrating an insulative displacement contact is engaged with a conductive wires.

FIG. 4 illustrates another embodiment of the light string of the present invention, the conductive legs 31, 32 can be embodied as an insulation displacement contact which can pierce through the insulative layer 21 of the conductive wire 2 and then reaches to the copper wire 22. By this arrangement, the LED 3 can be powered by the electricity transmitted thereto through the conductive wire 2.

Figure 5:
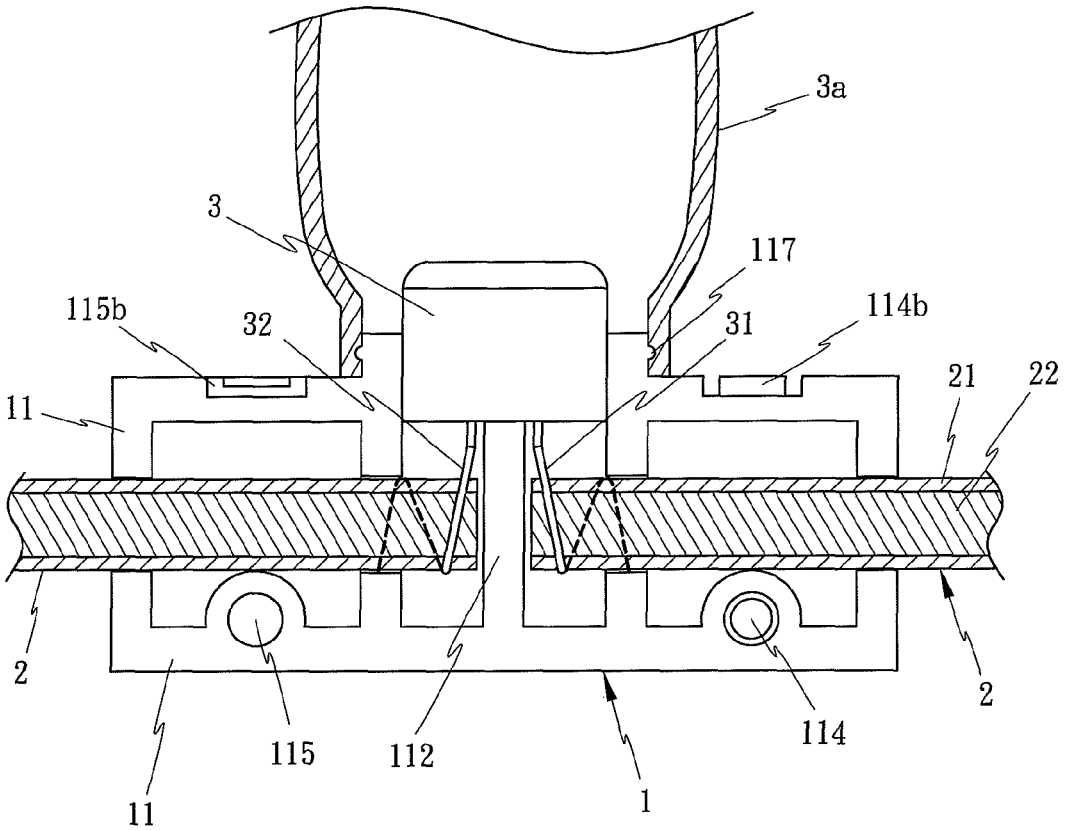
FIG. 5 is similar to FIG. 4 illustrating copper wires are wrapped around the conductive wires after it pieces through it.

As illustrated by FIG. 5, the conductive legs 31, 32 of the LED 3 can be embodied with an elongated pin which can pierce through the insulative layer 21 of the conductive wire 2 and reaches to the copper wire 22. Furthermore, the elongated pin can be further wrapped over the insulative layer 21 such that this wrapping creates an effect of strain relief so as to prevent the interconnection between the conductive legs 31 and 32 from separation with the copper wire 22 of the conductive wire 2.

The above described first and second casings 11 for the configuration of the bulb socket 1 is completely and symmetrically identical. As a result, no need for determining its orientation, or male or female. This arrangement can be conveniently suitable for mass production through automation as it can be readily fed. The provision of the buttons 114*a* and button holes 115*a*, and/or the latch 114*b* and latch holes 115*b* give a reliable and robust interengagement between the first and second casing 11 such that they are securely married. In addition, the teeth 116 or other suitable arrangements of the channels 113 can give a strong bite to the insulative layer 21 of the conductive wire 2. As a result, the components disposed with the first and second casings 11 are securely positioned without the possibility of getting loose.

The first and second casing 11 for configuring the bulb socket 1 as described above can be embodied into a first embodiment in which the two are separated from each other, and a second embodiment in which the two are interlinked by an interleaf such that one of the first and second casing 11 can be rotated and folded over the other one so as to configure the bulb socket 1. As a result, the buttons 114*a* and button boles 115*a* used thereof can be removed so as to further simplifying the overall configuration.

While the invention has been described with reference to a preferred embodiments of a genuine light string with socket configurations made with two symmetrically arranged casings, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. A light string configured with a plurality of bulb socket, conductive wires, and a plurality of LED electrically disposed within the bulb socket, characterized in that:

the socket is symmetrically configured by a first and second casings of hollow configuration each defined with an side opening having a partition located thereunder, an internal wall of the first and second casings being formed with a pair of channels located at longitudinal ends thereof, the internal wall of the first and second casings being further provided with interengaging arrangements such that the first and second casings can be interengaged, an LED seat is further defined by the opening of the first and second casing for installation of an LED, the two channels are further defined two passages for holding and routing conductive wires therethrough, and further insulatively separated by the partition;

the conductive wire is configured with a copper wire with insulative layer; and the LED is provided with a pair of legs disposed within a recess with in the bulb socket such the legs are electrically in contact with the copper wire of the conductive wires and further positioned by the marry of the first and second casings;

wherein buttons and button holes interlocked with each other when the first and second casings come together.

2. The socket as recited in claim to wherein the first and second casings are provided with latch and latch holes on the edge.

3. The socket as recited in claim 1, wherein an inner surface of the first and second channels is provided with circular teeth.

4. The socket as recited in claim 1, wherein the LED is provided with a pair legs in the form of insulation displacement contact which pieces through an insulative layer and reaches to the copper wire of the conductive wire.

5. The socket as recited in claim 1, wherein the LED is provided with a pair of legs in the form of an elongated pin piecing through the insulative layer and reaches to the copper wire of the conductive wire, and further wrapped over the insulative layer to create a strain relief.

6. The socket as recited in claim 1, wherein the first and second casings are individually formed.

7. The socket as recited in claim 1, wherein the first and second casings are interlinked with an interleaf.

* * * * *